US008699896B2

(12) United States Patent
Ishigaya et al.

(10) Patent No.: US 8,699,896 B2
(45) Date of Patent: Apr. 15, 2014

(54) FAILURE PREDICTOR, FIXING DEVICE, IMAGE FORMING APPARATUS, AND FAILURE PREDICTION SYSTEM

(75) Inventors: Yasunori Ishigaya, Yokohama (JP); Yasunari Mikutsu, Tokyo (JP); Ryota Yamashina, Yamato (JP)

(73) Assignee: Ricoh Company, Ltd., Tokyo (JP)

( * ) Notice: Subject to any disclaimer, the term of this patent is extended or adjusted under 35 U.S.C. 154(b) by 502 days.

(21) Appl. No.: 12/923,880

(22) Filed: Oct. 13, 2010

(65) Prior Publication Data

US 2011/0091226 A1 Apr. 21, 2011

(30) Foreign Application Priority Data

Oct. 15, 2009 (JP) ..... 2009-238217
Sep. 1, 2010 (JP) ..... 2010-195682

(51) Int. Cl.
*G03G 15/20* (2006.01)
*G03G 15/00* (2006.01)

(52) U.S. Cl.
USPC ..... 399/33; 399/36; 399/67; 399/69

(58) Field of Classification Search
USPC ..... 399/33, 36, 67, 69
See application file for complete search history.

(56) References Cited

U.S. PATENT DOCUMENTS 7,664,415 B2 2/2010 Mikutsu
8,064,782 B2 11/2011 Nakazato et al.
8,339,637 B2 12/2012 Nakazato et al.
8,358,941 B2 1/2013 Nakazato et al.
2005/0031364 A1 2/2005 Hayashi
2005/0117930 A1* 6/2005 Akizuki et al. ..... 399/69
2007/0217803 A1* 9/2007 Nakayama ..... 399/68
2008/0107436 A1 5/2008 Mikutsu (Continued)

FOREIGN PATENT DOCUMENTS

JP 03-63167 6/1991
JP 06-208265 A 7/1994

(Continued)

OTHER PUBLICATIONS

Office Action for corresponding Japanese patent application No. 2010-195682 dated Feb. 18, 2014.

*Primary Examiner* — Joseph S Wong
(74) *Attorney, Agent, or Firm* — Harness, Dickey & Pierce, P.L.C.

(57) ABSTRACT

A failure predictor for predicting failure of a fixing device including a first characteristics value extractor to extract a first characteristics value representing a time interval between each implementation of repair of a surface of one of a pair of rotary bodies, a second characteristics value extractor to extract a second characteristics value representing a change in a degree of glossiness on the surface of one of the pair of rotary bodies during a period of time between before and after repair of the surface of one of the pair of rotary bodies, a third characteristics value extractor to extract a third characteristics value representing a change in a current value of a drive motor, and a determination device to predict failure of the fixing device caused by the condition of the surface of one of the pair of rotary bodies using the extracted first, second, and third characteristics values.

3 Claims, 8 Drawing Sheets

(56) References Cited

U.S. PATENT DOCUMENTS

| | | | | |
|---|---|---|---|---|
| 2008/0253789 | A1 | 10/2008 | Yoshinaga et al. | |
| 2009/0003868 | A1* | 1/2009 | Namiki et al. | 399/69 |
| 2009/0052912 | A1* | 2/2009 | Soji et al. | 399/31 |
| 2009/0092409 | A1* | 4/2009 | Chiyoda et al. | 399/67 |
| 2009/0169232 | A1 | 7/2009 | Kunii et al. | |
| 2009/0297199 | A1 | 12/2009 | Yamashina et al. | |
| 2010/0061754 | A1 | 3/2010 | Ishigaya et al. | |
| 2010/0092220 | A1 | 4/2010 | Hasegawa et al. | |
| 2010/0092221 | A1 | 4/2010 | Shinshi et al. | |
| 2010/0239295 | A1 | 9/2010 | Mikutsu | |
| 2010/0310287 | A1 | 12/2010 | Mikutsu | |

FOREIGN PATENT DOCUMENTS

| | | | |
|---|---|---|---|
| JP | 10-149042 | | 6/1998 |
| JP | 2002-365967 | | 12/2002 |
| JP | 2005-49563 | | 2/2005 |
| JP | 2005309077 | A | 11/2005 |
| JP | 2007-127759 | | 5/2007 |
| JP | 2007-309980 | | 11/2007 |
| JP | 2008102474 | A | 5/2008 |
| JP | 2009-37141 | | 2/2009 |
| JP | 2009-128636 | | 6/2009 |

* cited by examiner

FAILURE PREDICTOR, FIXING DEVICE, IMAGE FORMING APPARATUS, AND FAILURE PREDICTION SYSTEM

PRIORITY STATEMENT

The present patent application claims priority from Japanese Patent Application Nos. 2009-238217, filed on Oct. 15, 2009, and 2010-195682, filed on Sep. 1, 2010, both in the Japan Patent Office, each of which is hereby incorporated herein by reference in its entirety.

BACKGROUND

1. Technical Field

Illustrative embodiments described in this patent specification generally relate to a failure predictor for a fixing device included in an image forming apparatus employing an electrophotographic method, a fixing device including the failure predictor, an image forming apparatus including the fixing device, and a failure prediction system.

2. Description of the Related Art

Related-art image forming apparatuses, such as copiers, printers, facsimile machines, and multifunction devices having two or more of copying, printing, and facsimile functions, typically form a toner image on a recording medium (e.g., a sheet of paper, etc.) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus.

Various techniques have been proposed to predict failure of the image forming apparatuses employing the electrophotographic method. One example of the technique involves obtaining a mixing ratio (absolute humidity) from temperature and humidity and uses the mixing ratio as an information amount together with output and adjusted values of a separation differential current to estimate defect rates for separation differential current regulation, a separation charger, and a transfer material by fuzzy inference. In another approach, probability of failure of a node is specified from an operating state value and a sheet conveyance time value using a Bayesian Network to extract points where failure has occurred or candidates of points where failure is likely to occur in the near future based on the probability thus specified. In yet another approach, a comprehensive index value is calculated taking into consideration operation control data of multiple types of apparatuses to determine presence or absence of irregularity in an apparatus or to predict failure of the apparatus based on the index value thus calculated.

The fixing device included in the image forming apparatus employing the electrophotographic method generally includes a pair of rotary bodies composed of a fixing member and a pressing member pressed against each other to form a fixing nip therebetween. The sheet bearing an unfixed toner image thereon is conveyed through the fixing nip so that heat and pressure are applied to the sheet. As a result, the toner image is melted and fixed onto the sheet.

Sheets having different sizes, thicknesses, or materials conveyed through the fixing nip or a separation pick that separates the sheets from the fixing member often scratch a surface of the fixing member, giving the toner image fixed onto the sheet an uneven glossiness.

In order to solve the above-described problem, the inventors of the present invention have invented a novel fixing device in which the condition of the surface of the fixing member is gauged and the surface of the fixing member is polished when a surface smoothness of the fixing member falls below a predetermined value. Specifically, a linear velocity of the fixing member is differentiated from that of the pressing member to generate slip therebetween at the fixing nip to recover the degraded surface of the fixing member.

Because the above-described fixing device having the function to recover the degraded surface of the fixing member has been newly invented, it is needless to say that a failure predictor that predicts or specifies factors for failure of such a fixing device is not yet found. None of the above-described related-art techniques is simply applicable to the newly-invented fixing device. Further, regardless of the function of recovering the degraded surface of the fixing member, a technique that can predict or specify occurrence of failure caused by degraded performance of the fixing device is not yet found. Therefore, it is necessary to provide a novel technique that can predict or specify occurrence of failure of the fixing device.

SUMMARY

In view of the foregoing, illustrative embodiments described herein provide a failure predictor that can predict or specify failure of a fixing device, a fixing device including the failure predictor, an image forming apparatus including the fixing device, and a failure prediction system.

At least one embodiment provides a failure predictor for predicting failure of a fixing device including a first characteristics value extractor to count a number of fixed sheets to extract a first characteristics value representing a time interval between each implementation of repair of a surface of one of a pair of rotary bodies based on the number of fixed sheets thus counted, a second characteristics value extractor to extract a second characteristics value representing a change in a degree of glossiness on the surface of one of the pair of rotary bodies measured by a glossiness measuring device during a period of time between before and after repair of the surface of one of the pair of rotary bodies, a third characteristics value extractor to extract a third characteristics value representing a change in a current value of a drive motor that rotates the pair of rotary bodies, and a determination device to predict failure of the fixing device caused by the condition of the surface of one of the pair of rotary bodies using the extracted first, second, and third characteristics values.

At least one embodiment provides a fixing device including: a pair of rotary bodies pressed against each other to form a fixing nip through which a recording medium having a toner image thereon is conveyed to fix the toner image onto the recording medium at a predetermined fixing temperature and pressure; a glossiness measuring device to direct light onto a surface of one of the pair of rotary bodies to measure a degree of glossiness on the surface of one of the pair of rotary bodies using a photocurrent generated by the light reflected from the surface of one of the pair of rotary bodies; the surface of one of the pair of rotary bodies is polished upon decline in the degree of glossiness thus measured below a predetermined value to repair the surface of one of the pair of rotary bodies; and the failure predictor described above.

At least one embodiment provides an image forming apparatus including the fixing device described above.

At least one embodiment provides a failure prediction system including an image forming apparatus, a terminal communicably connected to the image forming apparatus via a network, and the failure predictor described above. The first, second, and third characteristics value extractors are provided to the image forming apparatus, and the determination device is provided to the terminal to predict failure of a fixing device included in the image forming apparatus via the network.

At least one embodiment provides a failure predictor for predicting failure of a fixing device including a fourth characteristics value extractor to extract a fourth characteristics value representing an accumulated driving time of a rotation motor or substitutable data, a fifth characteristics value extractor to extract a fifth characteristics value representing an effective current value of a fixing nip formation motor upon formation of a fixing nip between a pair of rotary bodies, and a determination device to predict failure of the fixing device caused by a deterioration in an elastic layer of the pair of rotary bodies using the fourth and fifth characteristics values.

At least one embodiment provides a fixing device including: a pair of rotary bodies, one or both of which have an elastic layer; a fixing nip formation motor to press the pair of rotary bodies against each other to form a fixing nip therebetween through which a recording medium having a toner image thereon is conveyed to fix the toner image onto the recording medium at a predetermined fixing temperature and pressure, and to separate the pair of rotary bodies from each other to release the fixing nip; a rotation motor to rotate the pair of rotary bodies pressed against each other; and the failure predictor described above.

At least one embodiment provides an image farthing apparatus, including the fixing device described above.

At least one embodiment provides a failure prediction system including an image forming apparatus, a terminal communicably connected to the image forming apparatus via a network, and the failure predictor described above. The fourth and fifth characteristics value extractors are provided to the image forming apparatus and the determination device is provided to the terminal to predict failure of a fixing device included in the image farming apparatus via the network.

Additional features and advantages of the illustrative embodiments will be more fully apparent from the following detailed description, the accompanying drawings, and the associated claims.

BRIEF DESCRIPTION OF THE DRAWINGS

A more complete appreciation of the illustrative embodiments' described herein and the many attendant advantages thereof will be readily obtained as the same becomes better understood by reference to the following detailed description when considered in connection with the accompanying drawings, wherein.

Figure 1:
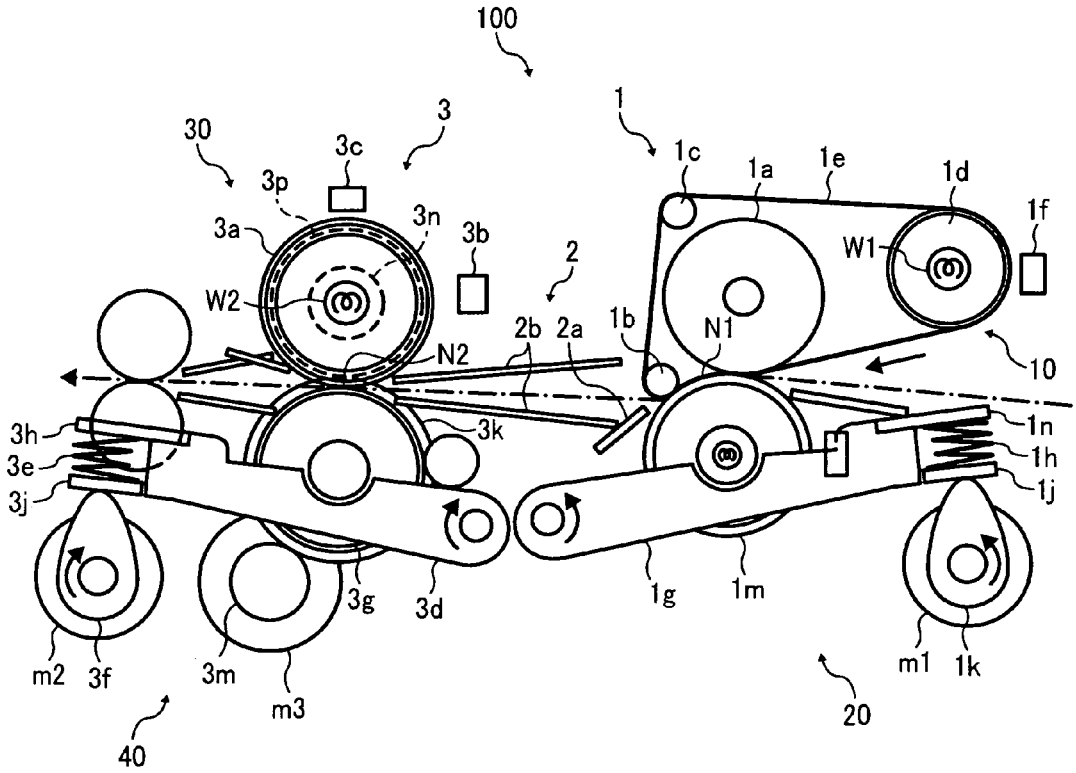
FIG. 1 is a schematic view illustrating a'configuration of a fixing device included in an image forming apparatus employing an electrophotographic method according to illustrative embodiments.

The accompanying drawings are intended to depict illustrative embodiments and should not be interpreted to limit the scope thereof. The accompanying drawings are not to be considered as drawn to scale unless explicitly noted.

DETAILED DESCRIPTION OF ILLUSTRATIVE EMBODIMENTS

In describing illustrative embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

A description is now given of illustrative embodiments of the present invention with reference to drawings; wherein like reference numerals designate identical or corresponding parts throughout the several views.

FIG. 1 is a schematic view illustrating a configuration of a fixing device 100 included in an image forming apparatus employing an electrophotographic method according to illustrative embodiments. The image forming apparatus forms a full-color or monochrome toner image based on image data sent from a scanner, a personal computer, or the like. The toner image thus formed is transferred onto a recording medium such as a sheet of paper, and the sheet having the transferred toner image thereon is conveyed to the fixing device 100 to fix the toner image onto the sheet. Because the basic configuration and operation of the image forming apparatus is well-known, descriptions thereof are omitted.

The fixing device 100 includes a first fixing unit 1, an intermediate guide unit 2, a second fixing unit 3, and a polishing mode controller, not shown.

The first fixing unit 1 includes a first fixing part 10 and a first pressing part 20. Referring to FIG. 1, the first fixing part 10 includes a first fixing roller 1*a* rotatably provided; a separation roller 1*b* rotatably provided at the lower left of the first fixing roller 1*a*; a tension roller 1*c* rotatably provided at the upper left of the first fixing roller 1*a*; a heat roller 1*d* including a heater W1 therein rotatably provided on the right of the first fixing roller 1*a*; a fixing belt 1*e* wound around the above-described rollers 1*a*, 1*b*, 1*c*, and 1*d*; a first temperature detector if that detects a temperature on a surface of the fixing belt 1*e* at a portion wound around the heat roller 1*d*; and a temperature controller, not shown, that controls power distribution of the heater W1 based on the temperature detected by the first temperature detector if to control the temperature on the surface of the fixing belt 1*e*. A diameter of the heat roller 1*d* is slightly smaller than that of the first fixing roller 1*a*. The fixing belt 1*e* is formed of silicone rubber laminated on a polyimide substrate, and a fluorinated resin is further laminated onto the silicone rubber to form a surface layer of the fixing belt 1*e*. The fixing belt 1*e* is heated by the heat roller 1*d* to have a predetermined temperature and is rotated in a clockwise direction in FIG. 1.

The first pressing part 20 is provided below the first fixing part 10. Specifically, the center of rotation of the first pressing part 20 is positioned at the lower left of the first fixing roller 1*a* in FIG. 1. The first pressing part 20 includes a first link 1*g* having a concave shaft receiver in the middle of an upper edge thereof and a plate-like receiver 1*n* at a tip portion thereof; a first plate-like pressing member 1*j* slidably provided to a casing of the fixing device 100 below the receiver in; a first compression spring 1*h*, both ends of which contact the first pressing member 1*j* and the receiver 1*n*, respectively; a first plate cam 1*k* provided in contact with the first pressing member 1*j* to be rotated by a first drive motor m1; a first pressing roller 1*m* rotatably supported by the shaft receiver of the first link 1*g*; and a drive motor, not shown, that rotatively drives the first pressing roller 1*m*. The first plate cam 1*k* pushes the first pressing member 1*j* upward to apply an upward force generated by the first compression spring 1*h* to the first link 1*g* via the receiver 1*n*. The first pressing roller 1*m* contacts the fixing belt 1*e* between the first fixing roller 1*a* and the separation roller 1*b* to press the fixing belt 1*e* against the first fixing roller 1*a* and the separation roller 1*b*. Specifically, the first pressing roller 1*m* is pushed upward by the first link 1*g*, the first plate cam 1*k*, and so forth, so that the first pressing roller 1*m* is pressed against the fixing belt 1*e* between the first fixing roller 1*a* and the separation roller 1*b* to form a first fixing nip N1 therebetween.

A recording medium such as a sheet of paper having a transferred toner image thereon passes through the first fixing nip N1 such that the toner image faces the fixing belt 1*e*. Accordingly, the toner image is melted by heat from the fixing belt 1*e* and fixed onto the sheet by pressure at the first fixing nip N1. A toner layer of the toner image fixed onto the sheet after passing through the first fixing nip N1 is deformable by an external force. The sheet having the fixed toner image thereon is then conveyed to the second fixing unit 3 through the intermediate guide unit 2 to be described later, and conveyance of the sheet in the fixing device 100 is indicated by a broken line arrow in FIG. 1.

Rotation of the first plate cam 1*k* is stopped at a position to lift the first link 1*g* to the highest position so that a predetermined upward force is applied to the first pressing roller 1*m* via the first link 1*g* to fix the toner image onto the sheet. By contrast, rotation of the first plate cam 1*k* is stopped at a position to move the first link 1*g* to the lowest position so that the predetermined upward force applied to the first pressing roller 1*m* via the first link 1*g* is released and the first fixing unit 1 is moved to a waiting state. It is to be noted that the position of the first plate cam 1*k* is controlled based on a result detected by an optical detector, not shown.

The intermediate guide unit 2 includes a pick 2*a* that separates the sheet discharged from the first fixing nip N1 from the first pressing roller 1*m*, and a pair of upper and lower plate-like intermediate guide members 2*b* that guides the sheet discharged from the first fixing nip N1 to a second fixing nip N2 to be described later.

The second fixing unit 3 includes a second fixing part 30, a second pressing part 40, and a drive unit, not shown, and is aligned with the first fixing unit 1 with the intermediate guide unit 2 disposed therebetween.

The second fixing part 30 includes a second fixing roller 3*a* serving as a fixing member having a heater W2 therein. The second fixing roller 3*a* is rotatably provided near a rear end of the pair of intermediate guide members 2*b* to face the first fixing roller 1*a* with the intermediate guide unit 2 disposed therebetween. The second fixing part 30 further includes a second temperature detector 3*b* provided a certain distance apart from the second fixing roller 3*a* to detect a temperature on an outer circumferential surface of the second fixing roller 3*a*; a temperature controller, not shown, that controls power distribution of the heater W2 based on the temperature detected by the second temperature detector 3*b* to further control the temperature on the outer circumferential surface of the second fixing roller 3*a*; and a glossiness measuring device, not shown, that measures a degree of glossiness on the surface of the second fixing roller 3*a*. Specifically, the glossiness measuring device includes an analog optical detector 3*c* provided a certain distance from the second fixing roller 3*a*. The analog optical detector 3*c* directs light onto the surface of the second fixing roller 3*a*, detects the light reflected from the surface of the second fixing roller 3*a*, and outputs a photocurrent. The glossiness measuring device measures a surface roughness of the second fixing roller 3*a* based on the photocurrent thus output to ultimately measure a degree of glossiness on the surface of the second fixing roller 3*a*.

The second fixing roller 3*a* includes a hollow metal core, an elastic layer such as a silicone rubber layer laminated on the metal core, and a surface layer formed of a fluorinated resin or a degenerated resin of the fluorinated resin laminated on the elastic layer.

In a gloss mode in which glossiness is imparted to the toner image formed on the sheet, the temperature on the surface of the second fixing roller 3*a*, that is, a second fixing temperature, is set to a predetermined temperature to appropriately impart glossiness to the toner image which is fixed onto the sheet by the first fixing unit 1. For example, the temperature on the surface of the second fixing roller 3*a* that contacts the fixed toner image on the sheet is lower than the temperature on the surface of the fixing belt 1*e* of the first fixing unit 1. Alternatively, it is preferable that the temperature on the surface of the second fixing roller 3*a* be equal to or higher than a temperature of the sheet entering into the second fixing unit 3 and equal to or lower than a temperature of the sheet immediately after discharging from the first fixing unit 1.

Further alternatively, it is preferable that the temperature on the surface of the second fixing roller 3*a* be in a range between a softening temperature of toner and a ½ flow starting temperature of toner, each measured using a flow tester, for example, CFT-500D manufactured by Shimadzu Corporation, under a condition of a load of 5 kg/cm$^2$ and an increasing temperature of 3.0 C.°/min using a nozzle with a diameter of 1.00 mm and a length of 10.0 mm. It is to be noted that the ½ flow starting temperature is an intermediate temperature between a flow start temperature and a flow ending temperature of toner.

Specifically, the temperature on the surface of the second fixing roller 3*a* is preferably between 60 C.° and 137 C.°, more preferably between 60 C.° and 120 C.°, and most preferably between 80 C.° and 100 C.°. It is to be noted that a temperature of toner varies depending on a color of toner, a toner lot, and so forth, and the temperature of toner here indicates an average temperature.

The second pressing part 40 is provided below the second fixing part 30. Specifically, in FIG. 1 the center, of rotation of the second pressing part 40 is positioned at the lower right of the second fixing roller 3*a*. The second pressing part 40 includes a second link 3*d* having a concave shaft receiver in the middle of an upper edge thereof and a plate-like receiver 3*h* at a tip portion thereof; a second plate-like pressing member 3*j* slidably provided to the casing of the fixing device 100 below the receiver 3*h*; a second compression spring 3*e*, both ends of which contact the second pressing member 3*j* and the receiver 3*h*, respectively; a second plate cam 3*f* provided in contact with the second pressing member 3*j* to be rotated by a second drive motor m2 serving as a fixing nip formation motor; and a second pressing roller 3*g* serving as a pressing member rotatably supported by the shaft receiver of the second link 3*d* to be pressed against the second fixing roller 3*a*. The second plate cam 3*f* pushes the second pressing member 3*j* upward to apply an upward force generated by the second compression spring 3*e* to the second link 3*d* via the receiver 3*h*.

The second fixing roller 3*a* and the second pressing roller 3*g* together serve as a pair of rotary bodies according to illustrative embodiments. The second pressing roller 3*g* is pushed upward by the second link 3*d*, the second plate cam 3*f*, and so forth, so that the second pressing roller 3*g* is pressed against the second fixing roller 3*a* to form the second fixing nip N2 therebetween.

Although the silicone rubber layer is provided as the elastic layer to the second fixing roller 3*a* as described above, alternatively, the elastic layer may be provided to the second pressing roller 3*g* in place of the second fixing roller 3*a*. Further alternatively, the elastic layer may be provided to both the second fixing roller 3*a* and the second pressing roller 3*g*.

The drive unit includes a first gear 3*k* provided on an axis of the second pressing roller 3*g*; a third drive motor m3 serving as a rotation drive motor having a pinion gear 3*m* engaging with the first gear 3*k*; a clutch 3*n*, an inner race of which is provided on an axis of the second fixing roller 3*a*; and a second gear 3*p* provided to an outer race of the clutch 3*n* to engage the first gear 3*k*. The first gear 3*k* and the second gear 3*p* have a different number of teeth.

During normal fixing operation (hereinafter also referred to as a fixing mode), rotation of the pinion gear 3*m* driven by the third drive motor m3 is transmitted to the first gear 3*k* to rotate the second pressing roller 3*g*, and the second gear 3*p* to which rotation of the first gear 3*k* is transmitted is idly rotated by the clutch 3*n* in an off-state. The second fixing roller 3*a* is rotatively driven by rotation of the second pressing roller 3*g* via the second fixing nip N2.

During operation to repair a degraded surface of the second fixing roller 3*a* (hereinafter also referred to as a polishing mode), the clutch 3*n* is turned on to forcibly rotate the second fixing roller 3*a* via the first gear 3*k*, the second gear 3*p*, and so forth. At this time, because the first and second gear 3*k* and 3*p* have a different number of teeth as described above, there is a difference in a linear velocity between the second fixing roller 3*a* and the second pressing roller 3*g*, causing slip at the second fixing nip N2. As a result, scratches on the surface of the second fixing roller 3*a* that may cause deterioration in image quality are polished to make the surface of the second fixing roller 3*a* flat and smooth. Based on experimental results, it is preferable that the difference in a linear velocity between the second fixing roller 3*a* and the second pressing roller 3*g* be set to about 5%.

The sheet having the fixed toner image thereon discharged from the first fixing nip N1 is then conveyed to the second fixing unit 3 through the intermediate guide unit 2 to pass through the second fixing nip N2, such that the fixed toner image faces the second fixing roller 3*a* having the predetermined temperature. Accordingly, flatness and glossiness is imparted by the surface of the second fixing roller 3*a* to the toner layer of the toner image deformable by external force. The toner layer is then cooled so that the toner image is completely fixed onto the sheet.

Rotation of the second plate cam 3*f* is stopped at a position (hereinafter referred to as the highest lifting position) to lift the second link 3*d* to the highest position, so that a predetermined upward force is applied to the second pressing roller 3*g* via the second link 3*d* to impart glossiness to the toner image fixed onto the sheet. By contrast, rotation of the second plate cam 3*f* is stopped at a position to move the second link 3*d* to the lowest position so that the predetermined upward force applied to the second pressing roller 3*g* via the second link 3*d* is released and the second fixing unit 3 is moved to a waiting state. It is to be noted that the position of the second plate cam 3*f* is controlled based on a result detected by an optical detector, not shown.

The polishing mode controller controls the fixing device 100 to enter the polishing mode each time the degree of glossiness on the surface of the second fixing roller 3*a* measured by the glossiness measuring device falls below a predetermined value set in advance, or the number of sheets passing through the second fixing nip N2 (hereinafter also referred to as the number of fixed sheets) reaches a predetermined value.

As described above, in the fixing device 100 according to illustrative embodiments, the first fixing unit 1 melts a toner image to be fixed onto the sheet, and the second fixing unit 3 imparts flatness and glossiness to the toner image to completely fix the toner image onto the sheet. The polishing mode controller implements the polishing mode to polish and repair the surface of the second fixing roller 3*a*.

Before describing a basic configuration of a failure predictor included in the fixing device 100 to predict or specify occurrence of failure in the fixing device 100, a relation between the number of fixed sheets, implementation of the polishing mode, and occurrence of failure in the fixing device 100 caused by deterioration in the second fixing roller 3*a* is described in detail below with reference to FIGS. 2 and 3.

Figure 2:
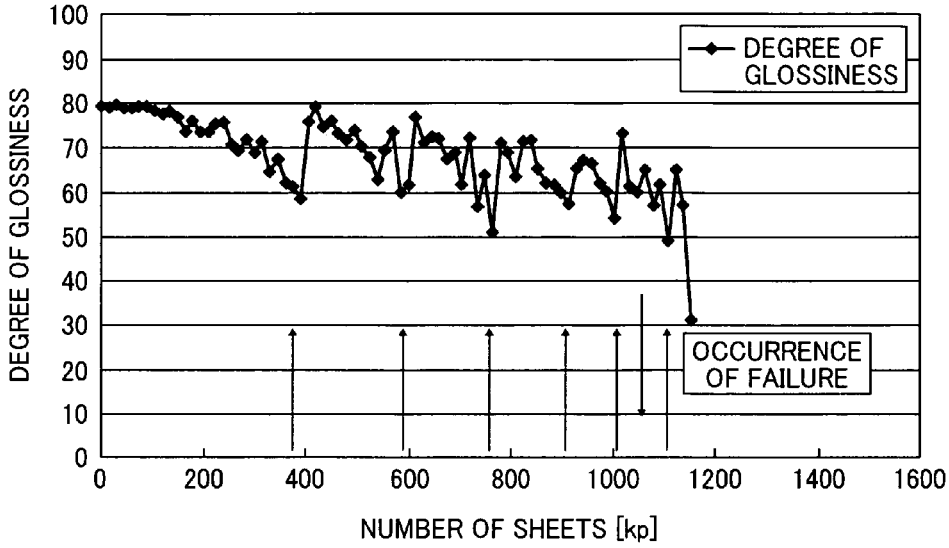
FIG. 2 is a graph showing a relation between a degree of glossiness on a surface of a second fixing roller and the number of sheets passing through a second fixing nip.

FIG. 2 is a graph showing a relation between a degree of glossiness on the surface of the second fixing roller 3*a* and the number of fixed sheets. Specifically, FIG. 2 shows change in the degree of glossiness on the surface of the second fixing roller 3*a* over time. In FIG. 2, the time of implementation of the polishing mode to repair the second fixing roller 3*a* is indicated by upward arrows.

As shown in FIG. 2, the degree of glossiness on the surface of the second fixing roller 3*a* is gradually degraded as the number of fixed sheets is increased. Although the degree of glossiness on the surface of the second fixing roller 3*a* is recovered each time the polishing mode is implemented, repeated implementation of the polishing mode causes failure of the fixing device 100. Further, intervals between each implementation of the polishing mode are gradually shortened as the polishing mode is repeatedly implemented. In other words, the total number of sheets passing through the second fixing nip N2 between each implementation of the polishing mode is gradually reduced as the polishing mode is repeatedly implemented. Accordingly, the state of deterioration in the second fixing roller 3*a* can be obtained from the intervals between each implementation of the polishing mode.

It is also clear from FIG. 2 that the effectiveness of polishing is gradually reduced as the polishing mode is repeatedly implemented, ultimately causing failure of the fixing device 100. Specifically, the second fixing roller 3*a* is reliably repaired by implementing the polishing mode in an early stage of use of the fixing device 100. However, as the number of fixed sheets is increased, the effectiveness of polishing is gradually reduced, and failure occurs in the fixing device 100 as the ultimate result. Therefore, the state of deterioration in the second fixing roller 3*a* can also be obtained from the effectiveness of polishing the surface of the second fixing roller 3*a*.

Figure 3:
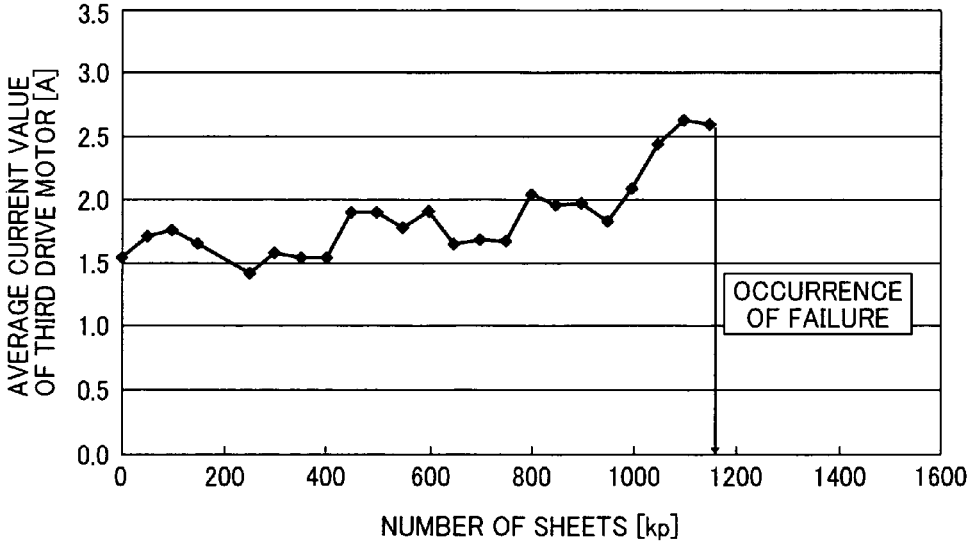
FIG. 3 is a graph showing a relation between an average current value of a third drive motor that drives a second pressing roller and the number of sheets passing through the second fixing nip.

FIG. 3 is a graph showing a relation between an average current value of the third drive motor m3 that drives the second pressing roller 3*g* and the number of fixed sheets. As shown in FIG. 3, a current value of the third drive motor 3*m* is increased as the number of fixed sheets is increased (or one or both of the second fixing roller 3*a* and the second pressing roller 3*g* is degraded). When a part of the surface layer of one or both of the second fixing roller 3*a* and the second pressing roller 3*g* is completely lost due to abrasion, the current value of the third drive motor m3 is considerably changed, causing failure of the fixing device 100. Accordingly, a state of deterioration in the second fixing roller 3*a* can also be obtained from the current value of the third drive motor m3.

The change in the current value of the third drive motor m3 varies depending on a material provided below the surface layer of each of the second fixing roller 3*a* and the second pressing roller 3*g*. Specifically, the silicone layer having a large frictional resistance is provided below the surface layer of the second fixing roller 3*a* so that the current value of the third drive motor m3 is increased.

A description is now given of a basic configuration of the failure predictor according to a first illustrative embodiment. The failure predictor according to the first illustrative embodiment includes a first characteristics value extractor, a second characteristics value extractor, a third characteristics value extractor, a determination device, and a monitoring result reporting device.

The first characteristics value extractor counts the number of fixed sheets that pass through the second fixing nip N2 from previous implementation of repair of the second fixing roller 3*a* (or the polishing mode) to present implementation thereof to extract a time interval between each implementation of repair of the second fixing roller 3*a* based on the number of fixed sheets thus counted. The time interval thus extracted is recorded as a first characteristics value. The second characteristics value extractor measures the surface roughness (or the degree of glossiness) of the second fixing roller 3*a* based on the photocurrent output from the analog optical detector 3*c* to extract a difference in the surface roughness of the second fixing roller 3*a* between before and after repair of the surface of the second fixing roller 3*a*. The difference in the surface roughness thus extracted is recorded as a second characteristics value. It is to be noted that, because the surface roughness of the second fixing roller 3*a* varies with each measurement, an average value thereof per unit of time may be obtained by performing sampling any number of times. The third characteristics value extractor measures a current value of the third drive motor m3 that rotates the second pressing roller 3*g* and the second fixing roller 3*a* to extract a current value of the third drive motor m3 during repair of the surface of the second fixing roller 3*a*. The current value of the third drive motor m3 thus extracted is recorded as a third characteristics value. It is to be noted that, because the current value of the third drive motor m3 varies with each measurement, an average value thereof per unit of time may be obtained by performing sampling any number of times.

Extraction and recording of the first to third characteristics values are performed each time the surface of the second fixing roller 3*a* is repaired or the number of fixed sheets reaches a predetermined value, for example, 200 kp (kp=1,000 sheets). The first to third characteristics values are treated as a single set of data and sent to the determination device to predict occurrence of failure.

The determination device according to the first illustrative embodiment includes three weak learners learned by boosting algorithms to respectively correspond to the first to third characteristics values, and an accumulator that calculates a determination index value F, which is obtained as a weighted majority rule determination result using a weighted majority rule, for each of pre-determination results output from the three weak learners, to predict or specify occurrence of failure based on the determination index value F thus calculated.

Operation of the weak learners and the accumulator is described in detail below.

First, histories of the set of data including the first to third characteristics values during a period of time from when the fixing device 100 normally operates (hereinafter referred to as a normal operating state) to occurrence of failure in the fixing device 100 are prepared. A period of time when failure occurs (hereinafter referred to as a failure state) is visually predicted from a shape of a transition graph of the histories for each data over time. The data corresponding to the failure state is labeled as a negative polarity, and the data corresponding to the normal operating state is labeled as a positive polarity.

The above-described series of processes is repeated multiple "i" times to obtain thresholds from b1 to bi for each data. Whether or not data is normal is determined for each data using the thresholds from b1 to bi to determine weighted values from $\alpha 1$ to $\alpha i$ to be added to data in which determination has failed and determination polarities from sgn1 to sgni, thereby ultimately selecting the weak learner having the highest accuracy. The threshold, the weighted value, and the determination polarity for each data are updatable.

Each of the weak learners is able to perform calculation with high processing speed and uses the above-described weighted majority rule, thereby achieving failure detection or prediction with improved accuracy and with less cost. The weak learners detect the state of the fixing device 100 using the following formula 1.

$$\mathrm{Out}i=1(sgni\times(Ci-bi)>=0)$$

$$\mathrm{Out}i=-1(sgni\times(Ci-bi)<0)$$

In formula 1, bi is a threshold for each of the characteristics values, and sgni is the determination polarity therefor.

The accumulator performs weighted majority rule determination on the pre-determination results output from the three weak learners respectively corresponding to the first to third characteristics values using the following formula 2.

$$F=\Sigma(i=1,n)(\alpha i\times \mathrm{Out}i)$$

In formula 2, $\alpha i$ is a weighted value added to each of the weak learners.

The determination device including the weak learners and the accumulator performs determination each time the surface of the second fixing roller 3*a* is repaired or the number of fixed sheets reaches a predetermined value, for example, 200 kp. When the determination index value F thus obtained is less than 0, the determination device predicts that failure is likely to occur in the near future, there is a strong possibility of failure, or failure has already occurred due to a degraded condition of the surface of the second fixing roller 3*a*, and outputs the prediction to the monitoring result reporting device to be described in detail later.

Figure 4:
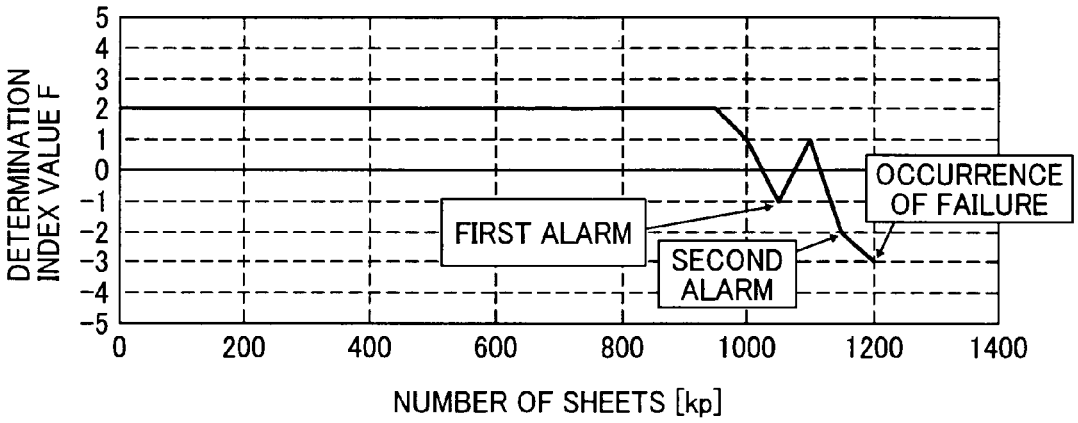
FIG. 4 is a graph showing a relation between a determination index value F and the number of sheets passing through the second fixing nip.

FIG. 4 is a graph showing change in the determination index value F over time. As shown in FIG. 4, the determination index value F falls to a negative value when failure caused by deterioration in the second fixing roller 3*a* occurs, thereby detecting a sign of occurrence of failure and actual occurrence of failure with higher accuracy.

The monitoring result reporting device displays the prediction of occurrence of failure or data on failure thus obtained on a liquid crystal operation panel provided to the image forming apparatus. When the image forming apparatus is connected to a network, the monitoring result reporting device sends an alarm to a service engineer or a user via e-mail. For example, the monitoring result reporting device issues a first alarm when the determination index value F is −1, and issues a second alarm when the determination index value F is −2. Because a sign or possibility of occurrence of failure in the fixing device 100 is reported in steps as described above, the service engineer or the user can definitely notice irregularity in the fixing device 100, thereby promptly and smoothly performing replacement or repair of the unit that fails.

As described above, when the degree of glossiness of the second fixing roller 3*a* falls below a predetermined value, the linear velocity of the second fixing roller 3*a* and the second pressing roller 3*g* is changed to polish the surface of the second fixing roller 3*a* so that the surface of the second fixing roller 3*a* is repaired in the fixing device 100. The failure predictor included in the fixing device 100 according to the first illustrative embodiment has the three weak learners created by boosting algorithms to respectively correspond to the first to third characteristics values. Weighted majority rule determination is performed on the pre-determination results output from the three weak learners to predict or specify occurrence of failure in the fixing device 100 caused by deterioration in the surface of the second fixing roller 3*a*.

A description is now given of the configuration and operation of a failure predictor according to a second illustrative embodiment. The failure predictor according to the second illustrative embodiment focuses on the fact that performance of the second fixing unit 3 is degraded as the elastic layer of the second fixing roller 3*a* (and/or the elastic layer of the second pressing roller 3*g*, if any) is/are degraded and a pressure at the second fixing nip N2 changes.

Figure 5:
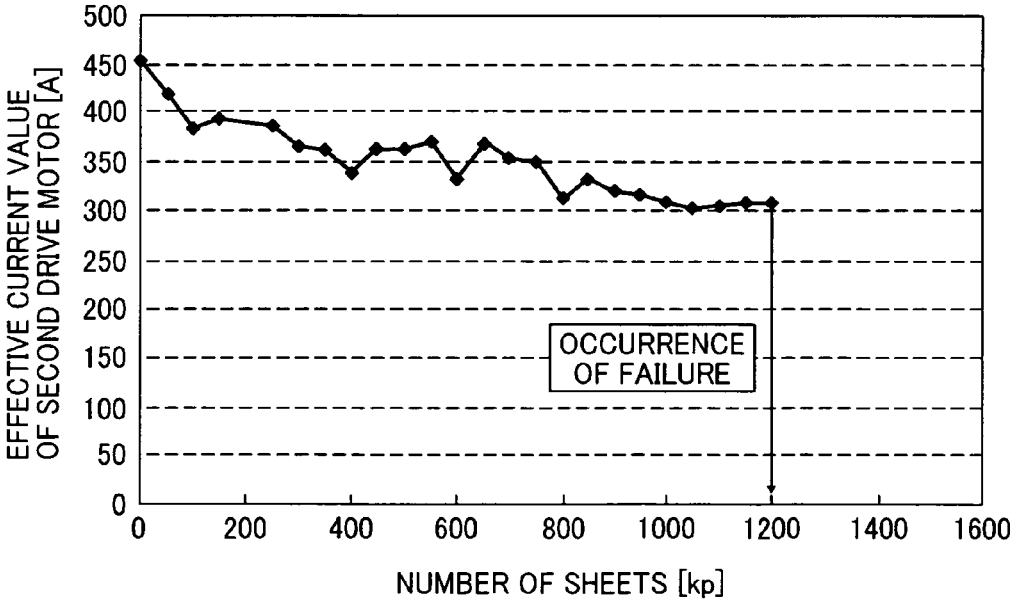
FIG. 5 is a graph showing a relation between an effective current value of a second drive motor and the number of sheets passing through the second fixing nip.
Figure 6:
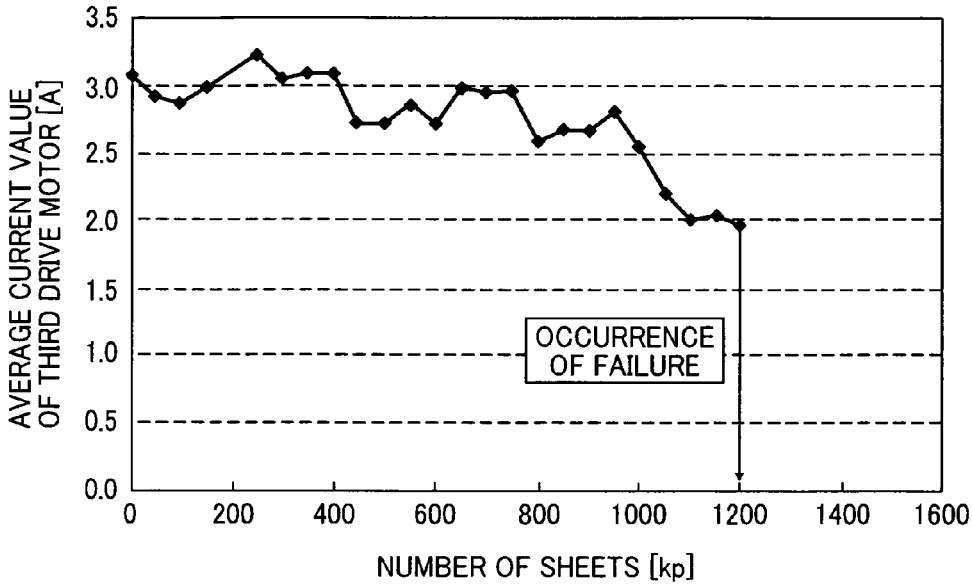
FIG. 6 is a graph showing a relation between an average current value of the third drive motor and the number of sheets passing through the second fixing nip.
Figure 7:
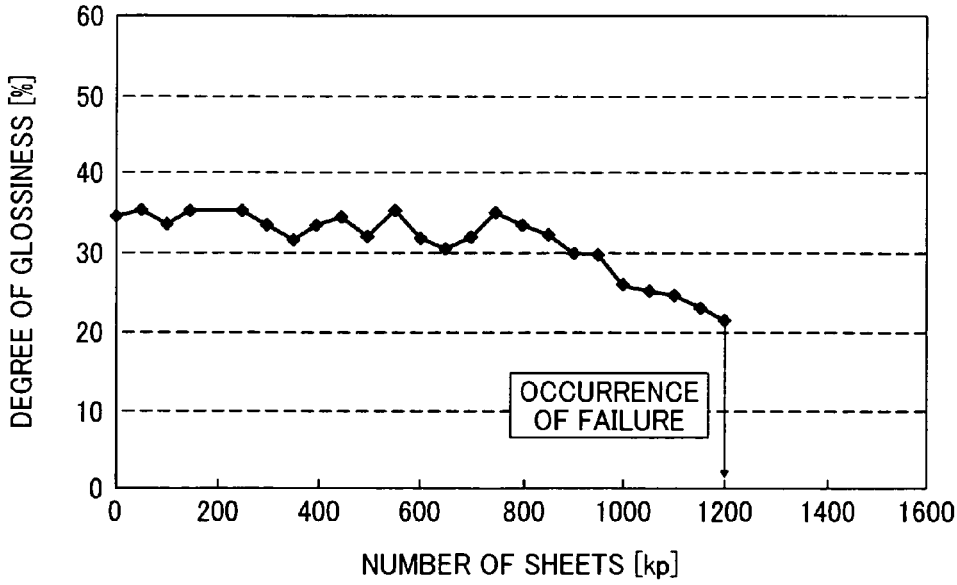
FIG. 7 is a graph showing a relation between a degree of glossiness imparted to a toner image and the number of sheets passing through the second fixing nip.

The pressure at the second fixing nip N2 is changed by a change in a repulsive force of the elastic layer of one or both of the second fixing roller 3*a* and the second pressing roller 3*g*. The change in the pressure at the second fixing nip N2 yields changes in current values of the second and third drive motors m2 and m3 under load as shown in FIGS. 5 and 6. FIG. 5 is a graph showing a relation between the effective current value of the second drive motor m2 and the number of fixed sheets. FIG. 6 is a graph showing a relation between an average current value of the third drive motor m3 and the number of fixed sheets. Further, the change in the pressure at the second fixing nip N2 yields a change in a degree of glossiness imparted to the toner image formed on the sheet as shown in FIG. 7. FIG. 7 is a graph showing a relation between the degree of glossiness imparted to the toner image and the number of fixed sheets.

Because it is proportional to an accumulated driving time of the third drive motor m3, deterioration in each of the second fixing roller 3*a* and the second pressing roller 3*g* over time can be obtained by monitoring the accumulated driving time of the third drive motor m3 or other substitutable data.

Further, the elastic layer of the second fixing roller 3*a* and that of the second pressing roller 3*g* are degraded in proportion to the number of fixed sheets. As a result, the effective current value of the second drive motor m2, the average current value of the third drive motor m3, and the degree of glossiness imparted to the toner image formed on the sheet are decreaSed particularly after the number of fixed sheets exceeds 900 kp as shown in FIGS. 5 to 7. When the number of fixed sheets reaches 1,200 kp, the second' fixing unit 3 cannot impart a desired degree of glossiness to the toner image formed on the sheet, causing failure of the fixing device 100.

To solve the above-described problems, the failure predictor according to the second illustrative embodiment includes a fourth characteristics value extractor, a fifth characteristics value extractor, a sixth characteristics value extractor, the determination device, and the monitoring result reporting device.

The fourth characteristics value extractor extracts an accumulated driving time of the third drive motor m3 from the start of use to the present and records the accumulated driving time thus extracted as a fourth characteristics value in order to obtain deterioration in the second fixing roller 3*a* and the second pressing roller 3*g* over time. The accumulated driving time thus recorded as the fourth characteristics value is not deleted even when the image forming apparatus is turned off. Alternatively, indirect data such as the number of fixed sheets or a total period of time when power is supplied to the image forming apparatus may be used as the fourth characteristics value. It is to be noted that in FIGS. 5 to 7, the number of fixed sheets is used as a time axis in place of the accumulated driving time of the third drive motor m3.

Figure 8:
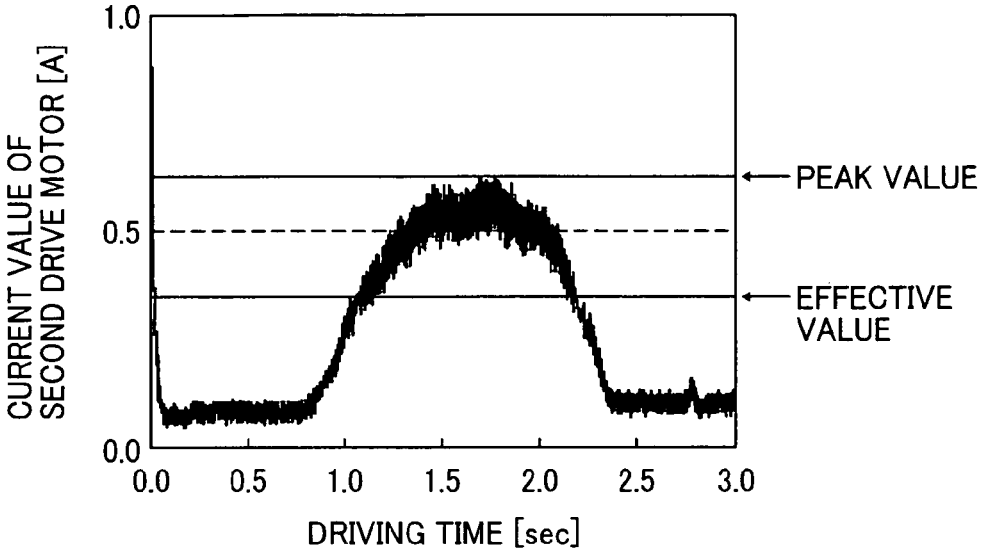
FIG. 8 is a graph showing a relation between an effective current value of the second drive motor and a driving time of a second plate cam.

The fifth characteristics value extractor extracts an effective current waveform value of the second drive motor m2 and records the effective current value thus extracted as the fifth characteristics value. FIG. 8 is a graph showing a current waveform of the second drive motor m2 while the second plate cam 3*f* revolves once. It is to be noted that the current waveform shown in FIG. 8 is an example obtained when the second plate cam 3*f* has a certain shape.

As the second plate cam 3*f* is rotated by the second drive motor m2, the second pressing roller 3*g* is pushed upward via the second link 3*d* to be pressed against the second fixing roller 3*a*. Accordingly, the elastic layer of the second fixing roller 3*a* (and the elastic layer of the second pressing roller 3*g*, if any) is compressed to generate a repulsive force, resulting in generation of a moment on the shaft of the second drive motor m2 corresponding to an amount of the repulsive force. Generation of the moment increases the current value of the second drive motor m2 in order to increase torque. Accordingly, the current value of the second drive motor m2 is gradually increased as the position of the second plate cam 3*f* approaches the highest lifting position.

By contrast, after the second plate cam 3*f* reaches the highest lifting position, the repulsive force is turned into a moment in a direction to rotate the shaft of the second drive motor m2. Accordingly, it is not necessary to increase the torque and the current value of the second drive motor m2 is decreased.

Figure 9:
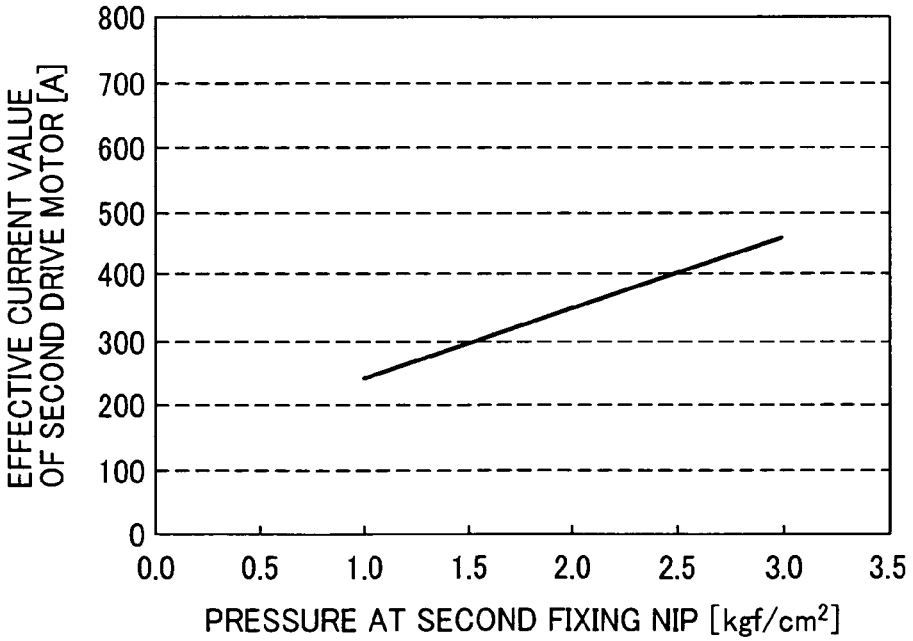
FIG. 9 is a graph showing a relation between an effective current value of the second drive motor and a pressure at the second fixing nip.

FIG. 9 is a graph showing a relation between the pressure at the second fixing nip N2 and the effective current value of the second drive motor m2. When the elastic layer of the second fixing roller 3*a* (and the elastic layer of the second pressing roller 3*g*, if any) is degraded over time and the pressure at the second fixing nip N2 is decreased, the current value of the second drive motor m2 under load is decreased so that deterioration in performance of the second fixing unit 3 can be determined.

As described above, the current waveform of the second drive motor m2 is changed as shown in FIG. 8 while the second plate cam 3*f* revolves once. Further, the current waveform of the second drive motor m2 is changed as the repulsive force of the elastic layer of the second fixing roller 3*a* (and the elastic layer of the second pressing roller 3*g*, if any) is decreased. The fifth characteristics value extractor records the effective current value of the second drive motor m2 as the fifth characteristics value to determine occurrence of failure.

A description is now given of calculation of the effective current value of the second drive motor m2. The effective current value of the second drive motor m2 is obtained by taking the square root of a one-cycle average of instantaneous values of a periodically changing current or voltage multiplied by itself based on a waveform in which an incoming current is excluded from the current waveform of the second drive motor m2 obtained while the second plate cam 3*f* revolves once. When the current waveform of the second drive motor m2 is a complete sine wave, the effective value is equal to 1 over the square root of 2 of the peak value. Accordingly, the peak value may be recorded as the fifth characteristics value when the second plate cam 3*f* has the same shape.

Although generally revolving once upon initialization or repair of the image forming apparatus, the second plate cam 3*f* also revolves once upon determination of occurrence of failure. Occurrence of failure is determined each time the accumulated driving time of the third drive motor m3 reaches a predetermined value, the number of fixed sheets reaches a predetermined value, or a total period of time when power is supplied to the image forming apparatus reaches a predetermined value.

The sixth characteristics value extractor extracts a current value of the third drive motor m3 under load and records the current value thus extracted as a sixth characteristics value. Specifically, similar to the current value of the second drive motor m2, the current value of the third drive motor m3 under load is decreased as the repulsive force of the elastic layer of the second fixing roller 3*a* (and/or the elastic layer of the second pressing roller 3*g*, if any) is decreased. Accordingly, the current value of the third drive motor m3 under load is recorded as the sixth characteristics value in the second illustrative embodiment. In such a case, it is preferable that an average of the current values of the third drive motor m3 obtained by performing sampling for a predetermined period of time be recorded as the sixth characteristics value.

Figure 10:
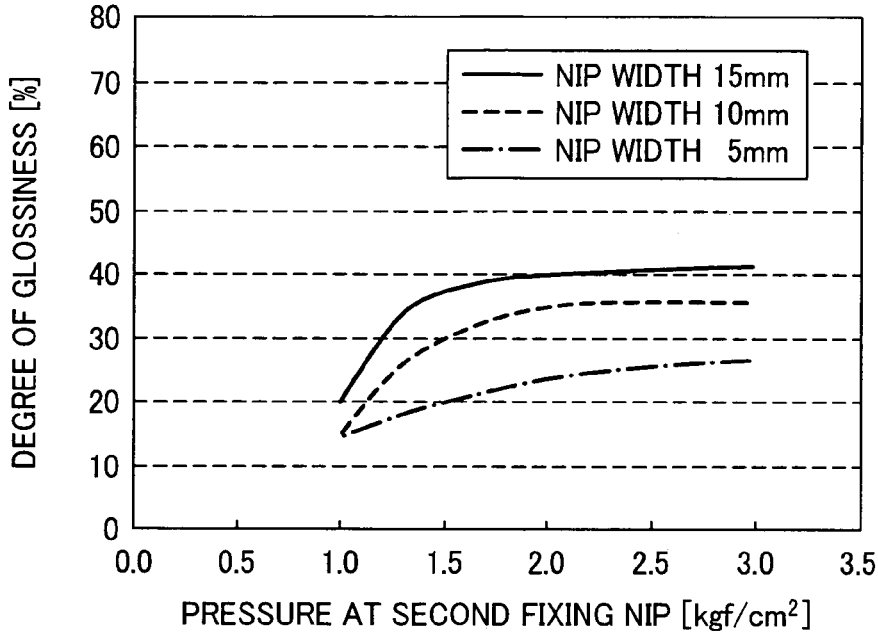
FIG. 10 is a graph showing a relation between a degree of glossiness imparted to the toner image and a pressure and width of the second fixing nip.

FIG. 10 is a graph showing a relation between the pressure and width of the second fixing nip N2 and the degree of glossiness imparted to the toner image by the second fixing unit 3.

As shown in FIG. 10, the larger the pressure at the second fixing nip N2 and the wider the width of the second fixing nip N2, the higher the degree of glossiness imparted to the toner image. When the elastic layer of the second fixing roller 3*a* (and/or the elastic layer of the second pressing roller 3*g*, if any) is degraded over time and the pressure and width of the second fixing nip N2 are decreased, the degree of glossiness imparted to the toner image formed on the sheet is decreased so that deterioration in performance of the second fixing unit 3 can be determined.

Figure 11:
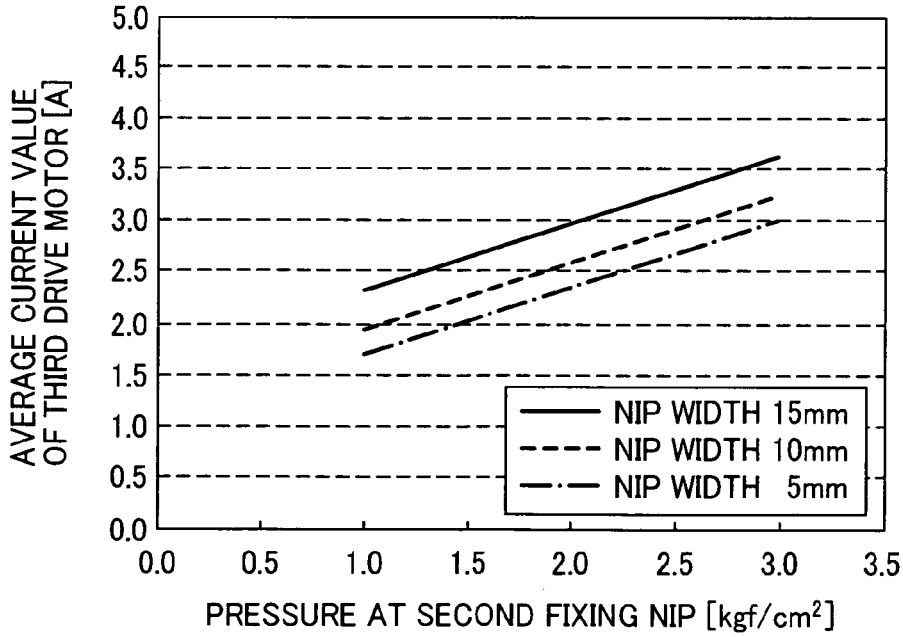
FIG. 11 is a graph showing a relation between an average current value of the third drive motor and a pressure and width of the second fixing nip.

FIG. 11 is a graph showing a relation between the pressure and width of the second fixing nip N2 and the average current value of the third drive motor m3 under load.

As shown in FIG. 11, both of the pressure and width of the second fixing nip N2 affect on a frictional force that causes torque on the third drive motor m3. When the elastic layer of the second fixing roller 3*a* (and/or the elastic layer of the second pressing roller 3*g*, if any) is degraded over time and the pressure and width of the second fixing nip N2 are decreased, the current value of the third drive motor m3 under load is decreased so that deterioration in performance of the second fixing unit 3 can be determined.

Extraction and recording of the fifth and sixth characteristics values to determine occurrence of failure are performed each time the accumulated driving time of the third drive motor m3, that is, the fourth characteristics value, recorded by the fourth characteristics value extractor reaches a predetermined value, or the number of fixed sheets reaches a predetermined value, for example, 200 kp. The fourth to sixth characteristics values are treated as a single set of data and sent to the determination device to predict occurrence of failure.

The determination device includes three weak learners learned by boosting algorithms to respectively correspond to the fourth to sixth characteristics values, and an accumulator that calculates a determination index value F, which is obtained as a weighted majority rule determination result using the weighted majority rule, for each of pre-determination results output from the three weak learners, to predict or specify failure based on the determination index value F thus calculated.

The determination device according to the second illustrative embodiment has the same basic configuration as the determination device according to the first illustrative embodiment. Selection of the weak learners respectively corresponding to the fourth to sixth characteristics values and determination of the threshold, the weighted value, and the determination polarity for each data are performed in the similar way as in the first illustrative embodiment.

The determination device including the weak learners and the accumulator performs determination of occurrence of failure each time the accumulated driving time of the third drive motor m3, that is, the fourth characteristics value, recorded by the fourth characteristics value extractor reaches a predetermined value, or the number of fixed sheets reaches a predetermined value, for example, 200 kp. When the determination index value F thus obtained is less than 0, the determination device predicts that failure is likely to occur in the near future, there is a strong possibility of failure, or failure has already occurred due to the degraded condition of the surface of the second fixing roller 3*a*, and outputs the prediction to the monitoring result reporting device.

Changes in the determination index value F over time are substantially the same as the result shown in FIG. 4. The determination index value F falls to a negative value when failure caused by deterioration in the second fixing roller 3*a* occurs, thereby detecting a sign of occurrence of failure and actual occurrence of failure with higher accuracy.

The monitoring result reporting device according to the second illustrative embodiment has the same basic configuration as the first, illustrative embodiment. Specifically, the monitoring result reporting device displays the prediction of occurrence of failure or data on failure thus obtained on the liquid crystal operation panel provided to the image forming apparatus. When the image forming apparatus is connected to a network, the monitoring result reporting device sends an alarm to a service engineer or a user via e-mail. For example, as shown in FIG. 4, the monitoring result reporting device issues a first alarm when the determination index value F is −1, and issues a second alarm when the determination index value F is −2. Because a sign or possibility of occurrence of failure in the fixing device 100 is reported in steps as described above, the service engineer or the user can definitely notice irregularity in the fixing device 100, thereby promptly and smoothly performing replacement or repair of the unit in which failure occurs.

As described above, when the pressure at the second fixing nip N2 is changed due to deterioration in the second fixing roller 3*a* and/or the second pressing roller 3*g* over time, the current value of each of the second and third drive motors m2 and m3 under load is decreased. The failure predictor according to the second illustrative embodiment has the fourth to sixth characteristics value extractors and the three weak learners created by boosting algorithms to respectively correspond to the fourth to sixth characteristics values obtained by the fourth to sixth characteristics value extractors. The failure predictor performs weighted majority rule determination on the pre-determination results output from the three weak learners to predict or specify occurrence of failure in the fixing device 100 caused by a decrease in the pressure at the second fixing nip N2. It is to be noted that, alternatively, the fourth characteristics value may be combined with one of the fifth and sixth characteristics values to predict or specify occurrence of failure in the fixing device 100.

A description is now given of a failure predictor according to a third illustrative embodiment.

The failure predictor according to the third illustrative embodiment uses the glossiness measuring device as a seventh characteristics value extractor that extracts the surface roughness of the second fixing roller 3*a* obtained based on the photocurrent output from the analog optical detector 3*c* and records the surface roughness thus extracted as a seventh characteristics value. Occurrence of failure is predicted or specified based on the seventh characteristics value thus recorded and the fourth to sixth characteristics values described above in the second illustrative embodiment. The failure predictor according to the third illustrative embodiment further includes a fixing temperature controller.

Figure 12:
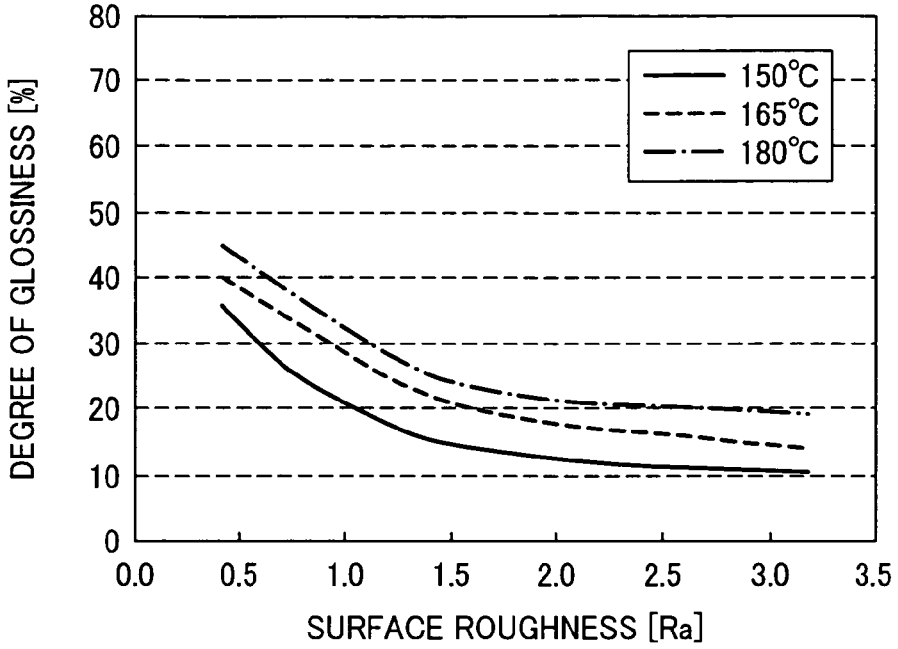
FIG. 12 is a graph showing a relation between a surface roughness of the second fixing roller and a degree of glossiness imparted to the toner image.

FIG. 12 is a graph showing a relation between the surface roughness of the second fixing roller 3*a* and the degree of glossiness imparted to the toner image formed on the sheet. The rougher the surface of the second fixing roller 3*a*, the lower the degree of glossiness of the toner image. Further, the higher the second fixing temperature, the higher the degree of glossiness of the toner image.

Figure 13:
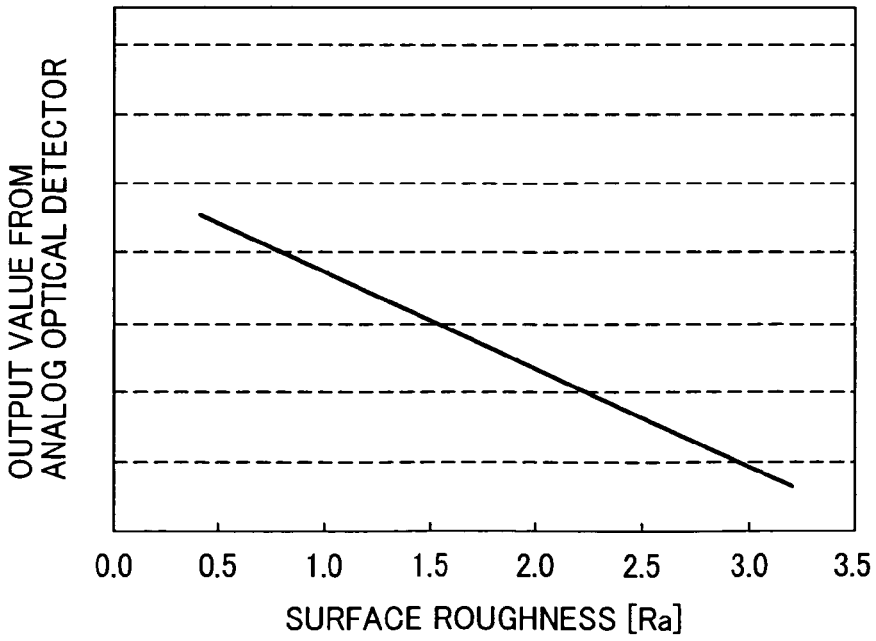
FIG. 13 is a graph showing a relation between an output value from an analog optical detector and a surface roughness of the second fixing roller.

FIG. 13 is a graph showing a relation between the surface roughness of the second fixing roller 3*a* and a value output from the analog optical detector 3*c*. The rough surface of the second fixing roller 3*a* decreases a surface reflectance thereof, thereby varying the value output from the analog optical detector 3*c*. It is to be noted that the values and slope shown in FIG. 13 are obtained under a certain condition, and are varied depending on the configuration of the second fixing roller 3*a*.

Figure 14:
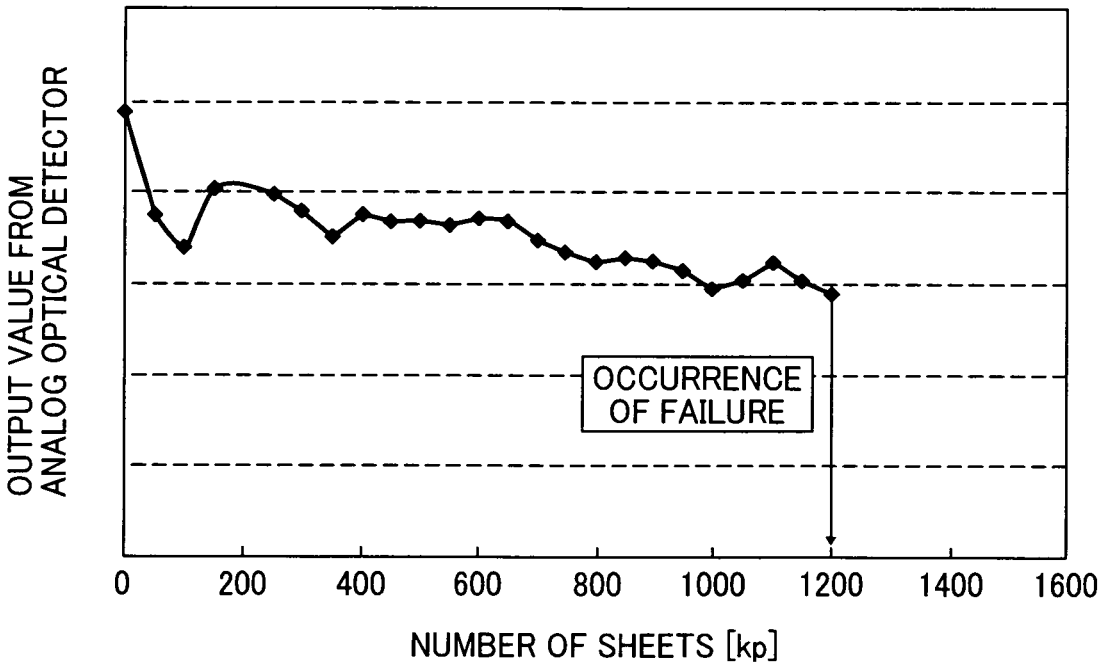
FIG. 14 is a relation between an output value from the analog optical detector and the number of sheets passing through the second fixing nip.

FIG. 14 is a graph showing a relation between the value output from the analog optical detector 3*c* and the number of fixed sheets. As shown in FIG. 14, the values output from the analog optical detector 3*c* are gradually decreased in proportion to the number of fixed sheets. In other words, the surface roughness of the second fixing roller 3*a* is increased as the number of fixed sheets is increased. In the example shown in FIG. 14, because of the rough and degraded surface of the second fixing roller 3*a*, it gradually becomes difficult to impart a desired degree of glossiness to the toner image by the second fixing roller 3*a* when the number of fixed sheets reaches 1,000 kp. When the number of fixed sheets reaches 1,200 kp, the desired degree of glossiness cannot be imparted to the toner image, resulting in failure in the second fixing unit 3.

Accordingly, the failure predictor according to the third illustrative embodiment uses the glossiness measuring device according to the first illustrative embodiment as the seventh characteristics value extractor as described above, and further includes the fourth to sixth characteristics value extractors according to the second illustrative embodiment. The value output from the analog optical detector 3*c* is recorded by the seventh characteristics value extractor as the seventh characteristics value. Extraction and recording of the characteristics values to determine occurrence of failure are performed at the same timing as the second illustrative embodiment.

The failure predictor according to the third illustrative embodiment includes four weak learners learned by boosting algorithms to respectively correspond to the fourth to seventh characteristics values, and an accumulator that calculates a determination index value F, which is obtained as a weighted majority rule determination result using the weighted majority rule, for each of pre-determination, results output from the four weak learners, to predict or specify failure based on the determination index value F thus calculated. Accordingly, occurrence of failure in the fixing device 100 due to a decrease in the pressure at the second fixing nip N2 and deterioration in the surface of the second fixing roller 3*a* can be predicted or specified.

As described above, the failure predictor according to the third illustrative embodiment further includes the fixing temperature controller that controls power distribution of the heater W2 to increase a temperature on the surface of the second fixing roller 3*a* by a predetermined value when the determination device determines that failure is likely to occur, that is, when the determination index value F that is obtained immediately before occurrence of failure in the fixing device 100 is determined by the determination device is obtained.

The rougher the surface of the second fixing roller 3*a*, the lower the degree of glossiness imparted to the toner image. However, when the second fixing roller 3*a* has the same surface roughness, then the higher the second fixing temperature, the higher the degree of glossiness imparted to the toner image as shown in FIG. 12. By using the above-described tendency, the fixing temperature controller increases the second fixing temperature when the determination index value F that is obtained immediately before occurrence of failure is determined by the determination device is obtained to prevent occurrence of failure in the fixing device 100, thereby extending a product life of the fixing device 100.

It is to be noted that illustrative embodiments of the present invention are not limited to those described above, and various modifications and improvements are possible without departing from the scope of the present invention. It is therefore to be understood that, within the scope of the associated claims, illustrative embodiments may be practiced otherwise than as specifically described herein. For example, elements and/or features of different illustrative embodiments may be combined with each other and/or substituted for each other within the scope of the illustrative embodiments.

Instead of employing all of the functions of the failure predictor according to the foregoing illustrative embodiments to the image forming apparatus, for example, occurrence of failure may be predicted or specified by a terminal connected to the image forming apparatus via a network. Specifically, the characteristics value extractors according to the foregoing illustrative embodiments may be provided to the image forming apparatus while the determination device including the weak learners respectively corresponding to the characteristics value extractors may be provided to the terminal communicably connected to the image forming apparatus via the network. The determination index value F is then calculated by the determination device based on the characteristics values sent from the image forming apparatus via the network to obtain a status of the fixing device 100 outside of the image forming apparatus. It is preferable that the monitoring result reporting device be further provided to the terminal to send e-mail reporting prediction or data of failure to a service engineer or a user.

The failure predictor may have both of the features thereof according to the first and second illustrative embodiments. Alternatively, the failure predictor may have both of the features thereof according to the first and third illustrative embodiments.

Although the second fixing unit 3 is subjected to prediction or detection of occurrence of failure according to the foregoing illustrative embodiments, alternatively, the first fixing unit 1 may be subjected to prediction or detection of occurrence of failure. Further, the foregoing illustrative embodiments are applicable to a fixing device having a single fixing unit to fix a toner image onto a sheet.

The determination device according to the foregoing illustrative embodiments calculates the weighted majority rule determination result using the weighted majority rule, for each of the pre-determination results output from the weak learners, in order to predict or specify occurrence of failure in the fixing device 100. Alternatively, the majority rule determination may be performed without weighting. Further alternatively, other prediction techniques may be used to configure the determination device.

What is claimed is:

1. A failure predictor for predicting failure of a fixing device comprising:

a fourth characteristics value extractor to extract a fourth characteristics value representing an accumulated driving time of a rotation motor or substitutable data;

a fifth characteristics value extractor to extract a fifth characteristics value representing an effective current value of a fixing nip formation motor upon formation of a fixing nip between a pair of rotary bodies;

a determination device to predict failure of the fixing device caused by a deterioration in an elastic layer of the pair of rotary bodies using the fourth and fifth characteristics values; and a seventh characteristics value extractor to extract a seventh characteristics value representing a photocurrent generated by light reflected from the pair of rotary bodies, wherein the determination device uses the seventh characteristics value to predict failure of the fixing device in addition to using the fourth characteristics value and the fifth characteristics value.

2. The failure predictor according to claim 1, further comprising a fixing temperature controller to increase a predetermined fixing temperature upon determination by the determination device that failure is likely to occur in the near future.

3. A failure predictor for predicting failure of a fixing device comprising:

a fourth characteristics value extractor to extract a fourth characteristics value representing an accumulated driving time of a rotation motor or substitutable data;

a fifth characteristics value extractor to extract a fifth characteristics value representing an effective current value of a fixing nip formation motor upon formation of a fixing nip between a pair of rotary bodies; and a determination device to predict failure of the fixing device caused by a deterioration in an elastic layer of the pair of rotary bodies using the fourth and fifth characteristics values, wherein the determination device comprises:

weak learners created using boosting algorithms to respectively correspond to the fourth and fifth characteristics values; and an accumulator that performs weighted majority rule determination for each of pre-determination results of the fourth and fifth characteristics values output from the weak learners, wherein the determination device predicts failure of the fixing device based on results obtained by performing weighted majority rule determination.

* * * * *